US006095876A

United States Patent [19]

Ozawa et al.

[11] Patent Number: 6,095,876

[45] Date of Patent: Aug. 1, 2000

[54] ENGINE COMPONENT LAYOUT

[75] Inventors: Shigeyuki Ozawa; Ryoichi Nakase, both of Shizuoka, Japan

[73] Assignee: Yamaha Hatsudoki Kabushiki Kaisha, Shizuoka, Japan

[21] Appl. No.: 09/020,368

[22] Filed: Feb. 9, 1998

[30] Foreign Application Priority Data

Feb. 7, 1997 [JP] Japan ..... 9-039882

[51] Int. Cl.[7] ..... B63H 21/10

[52] U.S. Cl. ..... 440/88; 440/900

[58] Field of Search ..... 440/88, 89, 900

[56] References Cited

U.S. PATENT DOCUMENTS 5,309,885 5/1994 Rawlings et al. .
5,340,344 8/1994 Mineo et al. ..... 440/88
5,524,597 6/1996 Hiki et al. .
5,634,832 6/1997 Nakase et al. ..... 440/88
5,846,102 12/1998 Nitta et al. ..... 440/88

*Primary Examiner*—Stephen Avila
*Attorney, Agent, or Firm*—Knobbe, Martens, Olson & Bear LLP

[57] ABSTRACT

A marine engine is constructed having an improved component layout so as to reduce the size of the engine even when multiple fuel injectors are employed per cylinder. In one mode, this advantage is accomplished while shielding the fuel injectors from water that may enter through an access opening above the engine. The fuel injectors are also desirably arranged to reduce thermal effects on the fuel injectors by remotely positioning the fuel injectors relative to the engine's exhaust system. In one form, the fuel injectors are mounted on a lower surface of an inclined cylinder and the exhaust pipe is connected to an upper surface of the cylinder for these purposes.

30 Claims, 13 Drawing Sheets

ENGINE COMPONENT LAYOUT

BACKGROUND OF THE INVENTION

1. Field of the Invention

The present invention relates in general to an engine, and in particular to a component layout for a marine engine, including an arrangement of the fuel injectors within the engine.

2. Description of Related Art

Internal combustion engines are commonly used to power small watercraft such as personal watercraft. These watercraft include a hull which defines an engine compartment. The engine is positioned in the engine compartment. The output shaft of the engine is coupled to a water propulsion device of the watercraft, such as an impeller.

Air must be supplied to the engine from outside the hull for use in the combustion process. Typically, air flows through one or more ducts in the hull into the engine compartment, and then through an intake system of the engine to the combustion chamber(s) of the engine.

Fuel is also supplied to the engine for use in the combustion process. In order to accurately meter the fuel and improve engine operating efficiency and performance, the fuel is injected with one or more fuel injectors. In this arrangement, fuel is supplied to the fuel injectors at high pressure. Each injector has an electrically operated valve which selectively opens and closes, controlling the flow of fuel through the injectors to the engine.

Personal watercraft also commonly include an access opening that is formed in the watercraft deck above the engine. A longitudinally extending, straddle-type seat normally covers the access opening to close the engine compartment and prevent an influx of water. On occasions, however, a rider may need to open the access opening while the watercraft is floating in a body of water in order to make minor repairs or adjustments.

Prior arrangements of the fuel injectors within the engine compartment pose the risk that water may enter the engine compartment through the open access opening and contact the fuel injectors, which can damage the fuel injectors and/or their electrical contacts. In addition, water that enters the engine compartment may also splash about within the watercraft hull due to the pitching and rocking movement of the watercraft as it moves through the water. In either event of direct contact or of subsequent internal splashing, the water can corrode the injector and/or interrupt the electrical current flow to the injectors. This may permanently damage the injectors as well as may affect the operation of the engine.

In order to keep the size of the watercraft small and the center of gravity low, the engine compartment is made very small, thus necessitating that the engine be compact. One problem with this arrangement is that hot exhaust gases flowing through the exhaust system from the engine may be routed very close to other components of the engine, damaging them or resulting in their poor performance. This is true of the fuel injectors, where the heat from the exhaust system may damage the injector and shorten its useful life.

Some prior watercraft have increased the width of the watercraft in order to separate the fuel injectors from the exhaust system. The associated engines have also employed a wider width in order to provide a component arrangement wherein the position of the intake pipe(s) does not interfere with the position of the fuel injectors and the associated fuel supply rail. Such watercraft, however, sacrifice the handling performance due to the resulting wider hull; the wider watercraft cannot turn as sharp.

These problems related to component arrangement are further exacerbated when multiple fuel injectors are used with each cylinder of the engine. Some personal watercraft engines recently have employed multiple fuel injector with each cylinder in an effort to enhance engine output power. It has been thought, however, that the use of multiple fuel injectors would result in a wider engine. Hence, watercraft designers have had to balance top end performance against handling performance.

SUMMARY OF THE INVENTION

One aspect of the present invention involves arranging the components of the engine to provide a compact engine employing either single or multiple fuel injectors per cylinder. In one mode, the fuel injectors are arranged on the engine so as to be shielded from water entering through the access opening.

In a more preferred mode, a watercraft comprises a hull defining an engine compartment. An internal combustion engine is positioned within the engine compartment and includes at least one combustion chamber. An intake system provides air to the combustion chamber and a fuel system provides fuel to the combustion chamber. The intake system includes an intake silencer and the fuel system includes at least one fuel injector. The fuel injector is arranged on the engine such that the intake silencer extends above at least a portion of the fuel injector.

In accordance with another aspect of the present invention, a small watercraft comprises a hull defining an engine compartment. An internal combustion engine is positioned within the engine compartment and includes at least one combustion chamber. An intake system provides air to the combustion chamber, and a fuel system, which includes at least one fuel injector, provides fuel to the combustion chamber. The fuel injector is positioned within the hull so as to be above the water surface level of the body of water in which the watercraft is operated with the hull floating in a normal upright position. The position of the fuel injector also ensures that the fuel injector lies above the water surface level with the hull floating in an inverted position.

An additional aspect of the present invention involves an internal combustion engine for a small watercraft. The engine comprises a crankshaft journalled to rotate about a first axis within a crankcase. At least one cylinder extends upwardly from the crankcase and forms at least a portion of a combustion chamber of the engine. An intake system includes at least one intake pipe that provides air to the cylinder. A fuel supply system, which includes at least one fuel injector, also provides fuel to the combustion chamber. The fuel injector lies in a skewed orientation relative to a plane that extends generally normal to the first axis and includes an axis of the cylinder. The fuel injector includes an influent end and an effluent end that communicates with the combustion chamber. The intake pipe is arranged on the engine such that at least part of the intake pipe is closer to the first axis than is the influent end of the fuel injector.

In accordance with another aspect of the present invention, an internal combustion engine for a small watercraft is provided. The internal combustion engine comprises a crankshaft journalled to rotate about a first axis within a crankcase. At least one inclined cylinder extends upwardly in an inclined manner from the crankcase and forms at least a portion of a combustion chamber. An intake system includes at least one intake pipe that provides air to the cylinder. The fuel system includes at least one fuel injector that delivers fuel to the combustion chamber. The fuel injector is connected to an upper surface of the inclined cylinder and the intake pipe is connected to the upper surface of the inclined cylinder.

An additional engine component arrangement involves at least one inclined cylinder that extends upwardly in an inclined manner from a crankcase. The cylinder forms at least a portion of a combustion chamber and an intake system communicates with the combustion chamber to provide air thereto. A fuel system includes at least one fuel injector that delivers fuel to the combustion chamber. The fuel injector is connected to a lower surface of the inclined cylinder. In this position, the fuel injector is shielded from the access opening, as well as from other engine components (e.g., the exhaust pipe).

In accordance with a further aspect of the present invention, an internal combustion engine for a small watercraft is provided. The engine comprises a crankshaft journalled to rotate about a longitudinal axis within a crankcase. At least a first cylinder extends upwardly from the crankcase and includes a longitudinal side that lies along the longitudinal axis and a pair of lateral sides that lie on opposite sides of the longitudinal axis. An intake system communicates with the cylinder to provide air thereto, and a fuel system, which includes at least a first fuel injector, delivers fuel to the first cylinder. An exhaust system also communicates with the cylinder to expel exhaust gases therefrom. The fuel injector is connected to the longitudinal side of the first cylinder, and the intake system and the exhaust system are connected to the lateral sides of the first cylinders on opposite sides of the longitudinal axis relative to each other.

An additional aspect of the present invention involves an internal combustion engine for a small watercraft. The engine comprises a crankshaft journalled to rotate about a first axis within a crankcase of an engine housing assembly. The engine housing assembly includes at least one cylinder that extends upwardly from the crankcase and forms at least a portion of a combustion chamber. An intake system includes at least one intake pipe that is connected to the engine housing assembly to provide air to the cylinder through an effluent end of the intake pipe. A fuel system includes at least one fuel injector to provide fuel to the combustion chamber. The fuel injector is skewed relative to a plane that lies generally normal to the first axis and includes an axis of the cylinder. The intake pipe is also arranged on the engine such that a flow axis through an effluent end of the intake is offset from the plane which contains the axis of the at least one cylinder.

Further aspects, features, and advantages of the present invention will become apparent from the detailed description of the preferred embodiments which follow.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF PREFERRED EMBODIMENTS OF THE INVENTION

The present engine has particular utility for use with personal watercraft, and thus, the following describes the propulsion system in the context of a personal watercraft. This environment of use, however, is merely exemplary. The present engine can be readily adapted by those skilled in the art for use with other types of watercraft a well, such as, for example, but without limitation, small jet boats and the like, as well as for use in other applications.

Figure 1:
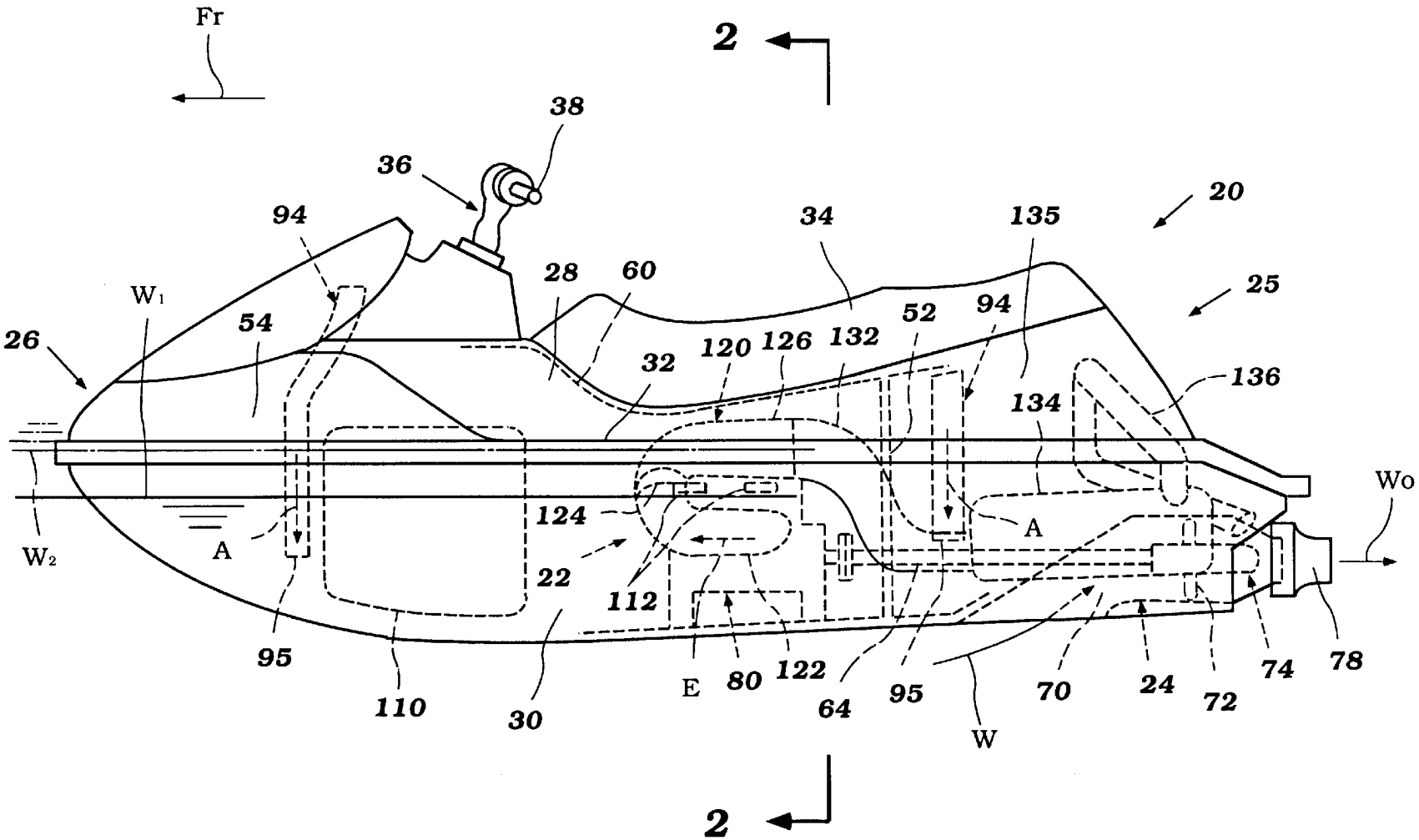
FIG. 1 is a side elevational view of the small watercraft that includes an engine configured in accordance with preferred embodiment of the present invention, and illustrates in phantom the engine and several other internal components of the watercraft.

FIG. 1 illustrates a watercraft 20 having a watercraft body 25 comprising a hull 26 having a top portion or deck 28 and a lower portion 30. A gunnel 32 defines the intersection of the lower portion 30 of the hull 26 and the deck 28. The watercraft 20 is suited for movement through a body of water W in a direction Fr (towards a front end of the watercraft).

A seat 34 is positioned on the top portion 28 of the hull 26. The seat 34 is preferably connected to a first removable deck member. A steering handle 36 is provided adjacent the seat 34 for use by a user in directing the watercraft 20. Preferably, a throttle control grip 38 is provided on the steering handle 36 for use in controlling the speed of the watercraft 20 as described in more detail below.

Figure 2:
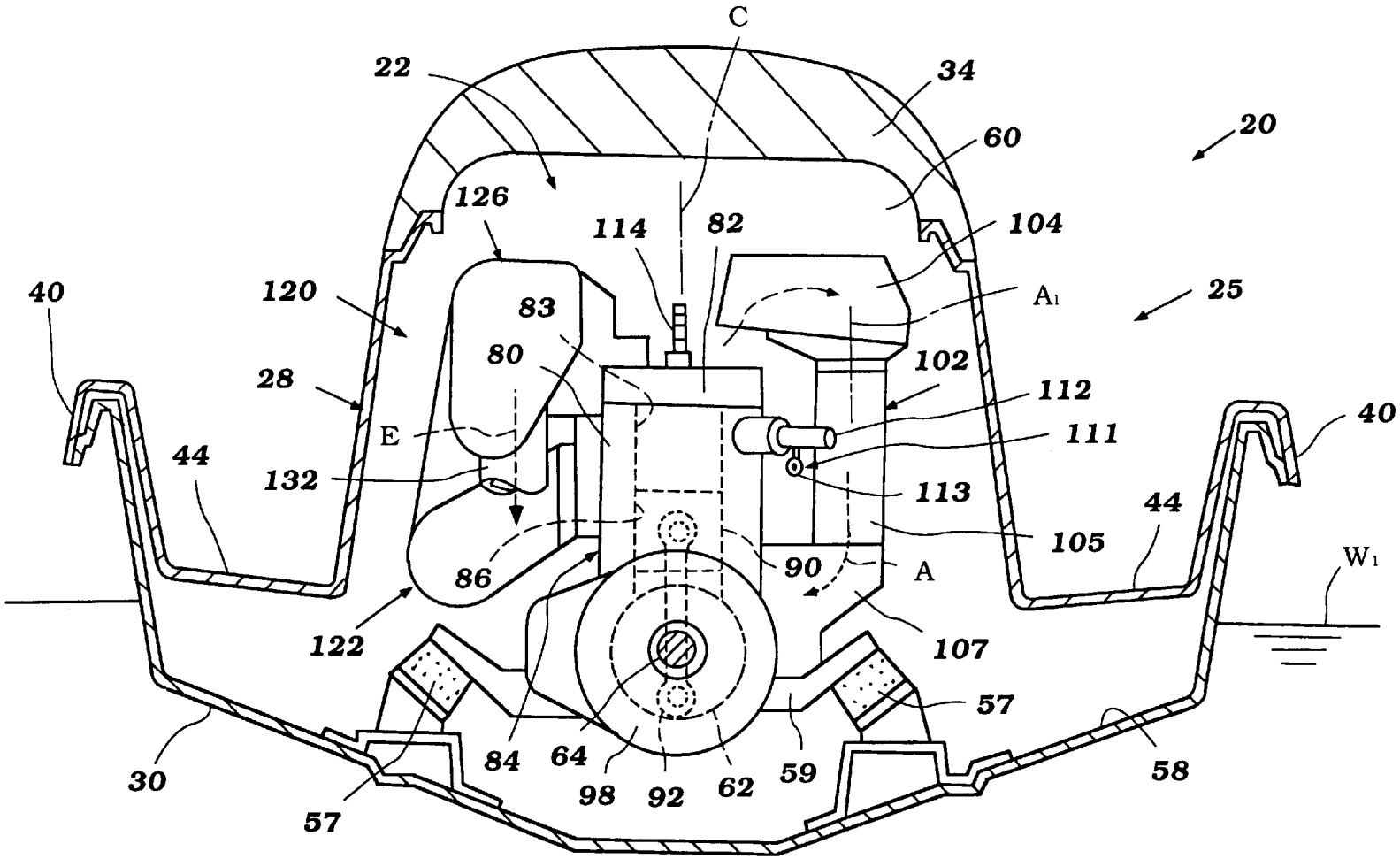
FIG. 2 is a cross-sectional view of the watercraft of FIG. 1 taken along line 2—2, and illustrates the marine engine from a front side.

As best illustrated in FIG. 2, a bulwark 40 extends upwardly along each side of the watercraft 20. A foot step area 44 is defined between the seat 34 and the adjacent bulwarks 40.

The top and bottom portions 28,30 of the hull 26, along with a bulkhead 52, define an engine compartment 54 and a pumping or propulsion unit compartment 56. The engine 22 is positioned in the engine compartment 54. As best illustrated in FIG. 2, the engine 22 is connected to the hull 26 with several brackets 59 via engine mounts 57 connected to a bottom 58 of the lower portion 30 of the hull 26. The engine 22 is preferably partially accessible through a maintenance opening 60 accessible by removing a deck member on which the seat 34 is mounted.

The engine 22 has a crankshaft 62 (see FIG. 2) which is in driving relation with an impeller shaft 64. The impeller shaft 64 rotationally drives a means for propelling water of a propulsion unit 24, which unit extends out a stem portion of the watercraft 20 (see FIG. 1).

The propulsion unit 24 includes a propulsion passage 70 having an intake port which extends through the lower portion 30 of the hull 28. The means for propelling water, preferably an impeller 72 driven by the impeller shaft 64, is positioned in the passage 70. The passage 70 also has an outlet jet 74 which discharges into a nozzle 78. The nozzle 78 is mounted for movement for directing water Wo which is expelled from the rear or stem of the watercraft 20, whereby the direction of the propulsion force for the watercraft 20, and thus its direction, may be varied. Preferably, the position of the nozzle 78 is controlled with the steering handle 36.

Figure 3:
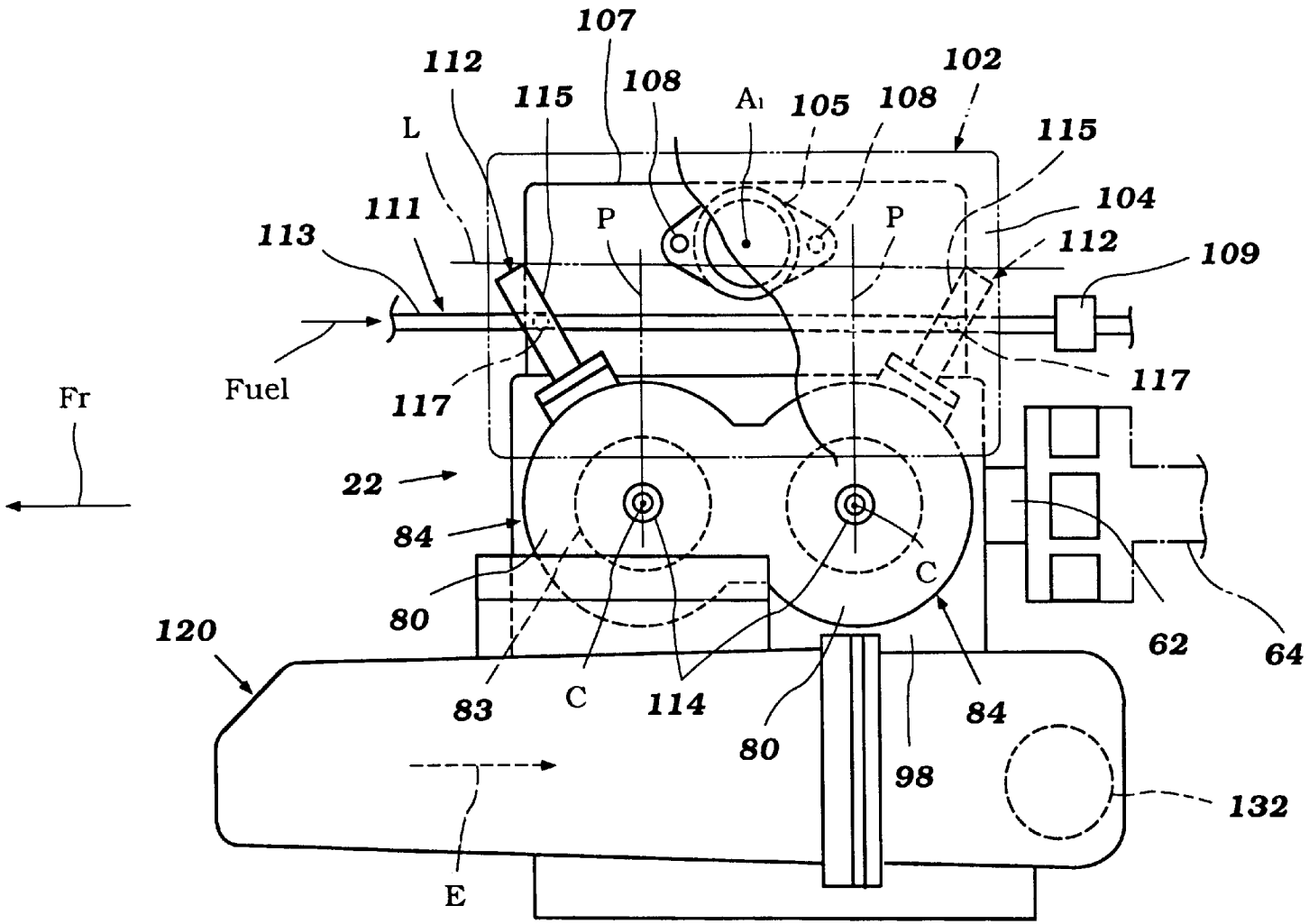
FIG. 3 is a top plan view of the marine engine of FIG. 1 with a portion of an intake silencer broken away to expose the relative positions of fuel injectors and an intake pipe of the engine.

The engine 22 is best illustrated in FIGS. 2–3. In the illustrated embodiment, the engine 22 includes two in-line cylinders 84. The engine 22 is positioned such that the row of cylinders 84 lies parallel to a longitudinal axis so the watercraft, running bow to stem, as best see in FIG. 3. Although the engine is illustrated as operating upon a two-stroke principle, it is understood that some of the principles of the present engine design can be incorporated into an engine that operates upon other combustion principles (e.g., a four-stroke principle). In addition those skilled in the art will readily appreciate that the present propulsion system can include any number of cylinders.

In the illustrated embodiment, the engine 22 includes a cylinder block 80 having a cylinder head 82 connected thereto and cooperating therewith to define two combustion chambers 83. A piston 90 is movably mounted in each cylinder 84 and slides along a cylinder wall 86 defined by the cylinder block 80. The piston 90 is connected to the crankshaft 62 via a connecting rod 92, as is well known in the art.

In the illustrated embodiment, the engine cylinders extend in an upright position, generally parallel to a vertical plane that contains the longitudinal axis, as well as the axes C of the cylinders 84. Each cylinder extends upwardly from a crankcase 98 of the engine, which is described in greater detail below. The engine, however, can be tilted or inclined relative to this vertical plane, as illustrated in several of the embodiments disclosed herein. As is well known in the art, an inclined orientation of the cylinders reduces the vertical profile of the engine without sacrificing displacement, thereby allowing the watercraft 20 to be designed with a low center of gravity.

The engine 22 includes an induction system to supply air to each cylinder 84. In the illustrated embodiment, air is drawn into the engine compartment 54 through several air ducts 94. As illustrated, a pair of ducts 94 are positioned in front of the engine 22 near the front end of the watercraft 20, and another duct 94 is positioned behind the engine 22 towards the stem of the watercraft. Each duct 94 defines a passage leading through the hull 26 to an outlet 95 positioned in the engine compartment 54. So arranged, air A flows from outside of the hull 26 into the engine compartment 54

With respect to FIGS. 2 and 3, air within the engine compartment 54 is supplied to the engine 22 through an air intake system 102. The intake 102 includes an intake box or silencer 104 into which air from within the engine compartment 54 is drawn, the air then delivered therefrom to a passage through a throttle body 108. A throttle valve (not shown) is movably positioned in the passage through the throttle body 108. The valve is preferably controlled by the throttle control 38 located at the steering handle 36, and is arranged control the flow rate of air through the throttle body 108.

The air which selectively passes beyond the throttle valve through an intake pipe 105 and then selectively through an intake port into a crankcase 98 as controlled by a reed valve (not illustrated in FIG. 2, but see FIG. 8, reference numeral 118*e* for an example), as is known in the art. In the illustrated embodiment, the intake pipe 105 has a generally tubular shape with a central flow axis A,. An effluent end of the intake pipe 105 is connected to an intake manifold 107 that is integrally formed with the crankcase 98.

The crankcase 98 is preferably defined at the bottom of the engine 22 by the cylinder block 80 and a crankcase cover member. As illustrated in FIG. 3, the crankshaft 62 is rotatably positioned in the crankcase 98.

The crankcase 98 is compartmentalized into crankcase chambers, one chamber corresponding to each cylinder 84. As is well known, an intake port and corresponding reed valve (not shown) are preferably provided within each crankcase chamber.

In this arrangement, air delivered to a particular crankcase chamber is partially compressed by the downward movement of the piston 90 corresponding to that chamber. This air is then delivered from the crankcase 98 to the cylinder 84 through one or more scavenge passages (not shown). When the piston 90 moves upwardly, air is drawn through the reed valve into the crankcase 98 to supply the next air charge.

Fuel is provided to each cylinder 84 by a fuel system 111. In the embodiment illustrated, fuel is drawn from a fuel tank 110 (see FIG. 1) positioned in the engine compartment 54 by a fuel pump (not shown). The fuel is delivered at high pressure through a fuel rail or tube 113 to a fuel injector 112 corresponding to each cylinder 84 and which delivers fuel thereto. The fuel injectors 112 will be described in more detail below. A pressure regulator 109 regulates the fuel pressure within the fuel rail 113.

As best understood from FIG. 3, each fuel injector 112 includes an influent end, generally designated by reference numeral 115, and an effluent end (not shown) which is positioned within the cylinder block 80 and in communication with the corresponding combustion chamber 83. The influent ends of each fuel injector include inlet ports 117 through which the fuel injectors communicate with the fuel rail 113.

A suitable ignition system is provided for igniting the air and fuel mixture in each combustion chamber. Preferably, this system comprises a spark plug 114 (see FIGS. 2 and 3) corresponding to each cylinder 84. The spark plugs 114 are preferably fired by a suitable ignition system as well known to those of skill in the art, and are mounted in the cylinder head 82 with their gaps positioned generally at the upper center of each cylinder 84.

Exhaust gas generated by the engine 22 is routed from the engine to a point external to the watercraft 20 by an exhaust system 120 which includes an exhaust passage leading from each cylinder 84 through the cylinder block 80. An exhaust manifold or pipe 122 is connected to a side of the engine 22. As best illustrated in FIG. 2, the exhaust manifold 122 is connected to one side of the engine 22, while the intake system 102 of the engine 22 extends from the opposite side of the engine.

The manifold 122 has a pair of branches each having a passage there through which aligns with one of the exhaust passages leading through the cylinder block 80 from a cylinder 84. The branches of the manifold 122 merge at a merge pipe portion of the manifold which curves around on the front end of the engine 22. The merge pipe portion has a passage through which the exhaust is routed.

An expansion pipe 126 is connected to the exhaust manifold 122, preferably via a flexible member 124, such as a rubber sleeve, as seen in FIG. 1. The expansion pipe 126 has an enlarged passage through which exhaust gas E flows from the passage in the exhaust manifold 122. As illustrated, the expansion pipe 126 extends from its connection to the manifold 122 near the front end of the engine 22 along the upper side of the engine in an elevated position.

After flowing through the expansion pipe 126, the exhaust flows into an upper exhaust pipe section 132 of the exhaust system 120 (see FIG. 1). This portion of the exhaust system 120 leads to a water lock 134. The upper exhaust pipe 132 is preferably connected to the water lock 134 via a flexible fitting, such as a rubber sleeve. The exhaust flows through the water lock 134, which is preferably arranged as known to those skilled in the art, to prevent the backflow of water through the exhaust system 120 to the engine 22. The exhaust then passes to a lower exhaust pipe 136 which has its terminus in the water near the stem of the watercraft 20. In this manner, exhaust flows from the engine 22 through the exhaust system 120 to its discharge within the water or near the surface level of the water $W_1$. As best illustrated in FIG. 1, the water lock 134 and the lower exhaust pipe 136 desirably are located within a pump chamber 135 positioned behind the bulkhead 52.

The engine 22 may include a suitable lubricating system for providing lubricating oil to the various moving parts thereof and for injection with the fuel. In addition, the engine 22 may include a suitable liquid and/or air cooling system.

In illustrated embodiment of the engine, the fuel injectors 112 are specifically positioned or arranged so that their exposure to water and heat is reduced or limited, while providing a compact engine. In this embodiment, an injector 112 is provided corresponding to each cylinder 84. Each injector 112 is connected to a respective portion of the cylinder body 80 and is arranged to direct fuel into a respective cylinder 84. As best seen in FIGS. 2 and 3, the fuel injectors lie beneath the intake silencer 102 on either side of the intake pipe 105 and above the intake manifold. That is, at least a portion of the intake silencer 104 lies between the access opening and at least a portion of the fuel injector 112. In this position, the injectors 112 are shielded from water that may enter the engine compartment 54 through the access opening 60, and are arranged so as not to interfere with the position of the intake pipe 105, thereby decreasing the width of the engine 22. In the illustrated embodiment, the access opening 60 is arranged above at least a portion of the engine 22, as best seen in FIG. 2.

The fuel injectors 112 are also arranged on the engine 22 such that a first distance between the influent ends 115 of the fuel injectors is different than a second distance between the effluent ends of the fuel injectors 112. In the illustrated embodiment, the first distance is greater than the second distance; however, the fuel injectors 112 could be arranged such that the second distance is greater than the first distance (see the adjacent fuel injectors of the two cylinders illustrated in FIG. 6 for an example). In either case, the fuel rail desirably lies generally parallel to the rotational axis of the crankshaft 62.

To position the fuel injectors 112 on either side of the intake pipe 105, the injectors 112 desirably are skewed relative to a vertical plane that lies perpendicular to an axis of the crankshaft 62. In particular, as best seen in FIG. 3, each fuel injector lies at an oblique angle relative to a plane P that extends in a lateral direction and perpendicular to the crankshaft rotational axis. This plane P desirably also contains the axis C of the corresponding cylinder 84. In the illustrated embodiment, an incident angle between the injector 112 and the corresponding plane P ranges between 5 and 45 degrees, and desirably equals about 15 to 30 degrees.

As such, the effluent end of each fuel injector 112 lie closer to the plane P than does the corresponding influent end 115. In addition, the intake pipe 105 is arranged on the engine 22 such that a flow axis A of the intake pipe at an effluent end of the intake pipe 105 lies on one side of the plane P and the influent end of the fuel injector 112 lies on the other side of the plane. The fuel injectors 112, however, can be arranged on the engine 22 such that the influent end of each fuel injector 112 lies closer to the plane P than does the effluent end. With this arrangement, the effluent end of the intake pipe 105 would lie on one side of the plane P while the effluent end of the fuel injector 112 would lie on the other side of the plane P.

In order to further reduce the width of the engine, the intake pipe 105 is arranged closer to the rotational axis of the crankshaft 62 than are the out ends of the fuel injectors 112. In particular, as seen in FIG. 3, at least a portion of the intake pipe 105 lies between the axis of the crankshaft 62 and a line L that extends between the outer influent ends 115 of the fuel injectors and lies generally parallel to the crankshaft axis. By moving at least a portion of the intake pipe 105 into the valley formed between the two fuel injectors 112, the lateral width of the engine 22 is decreased.

The present engine component arrangement also positions the fuel injectors 112 on a side of the cylinders 84 opposite of the exhaust system 120. In this manner, the fuel rail 113 and fuel injectors 112 are spaced apart from the exhaust system in order to reduce the thermal effects on the fuel within the fuel delivery system caused by the hot operating temperatures that occur within the exhaust system 120.

The position of the fuel injectors 112 within the engine compartment 54 also inhibits the fuel injectors 112 from becoming submerged should the watercraft capsize. As seen in FIG. 1, the fuel injectors 112 normally reside above the water level $W_1$ when the watercraft is floating in an upright position. When the watercraft is inverted, the fuel injectors 112 also reside above the water level $W_2$, as schematically illustrated in FIG. 1.

Figure 4:
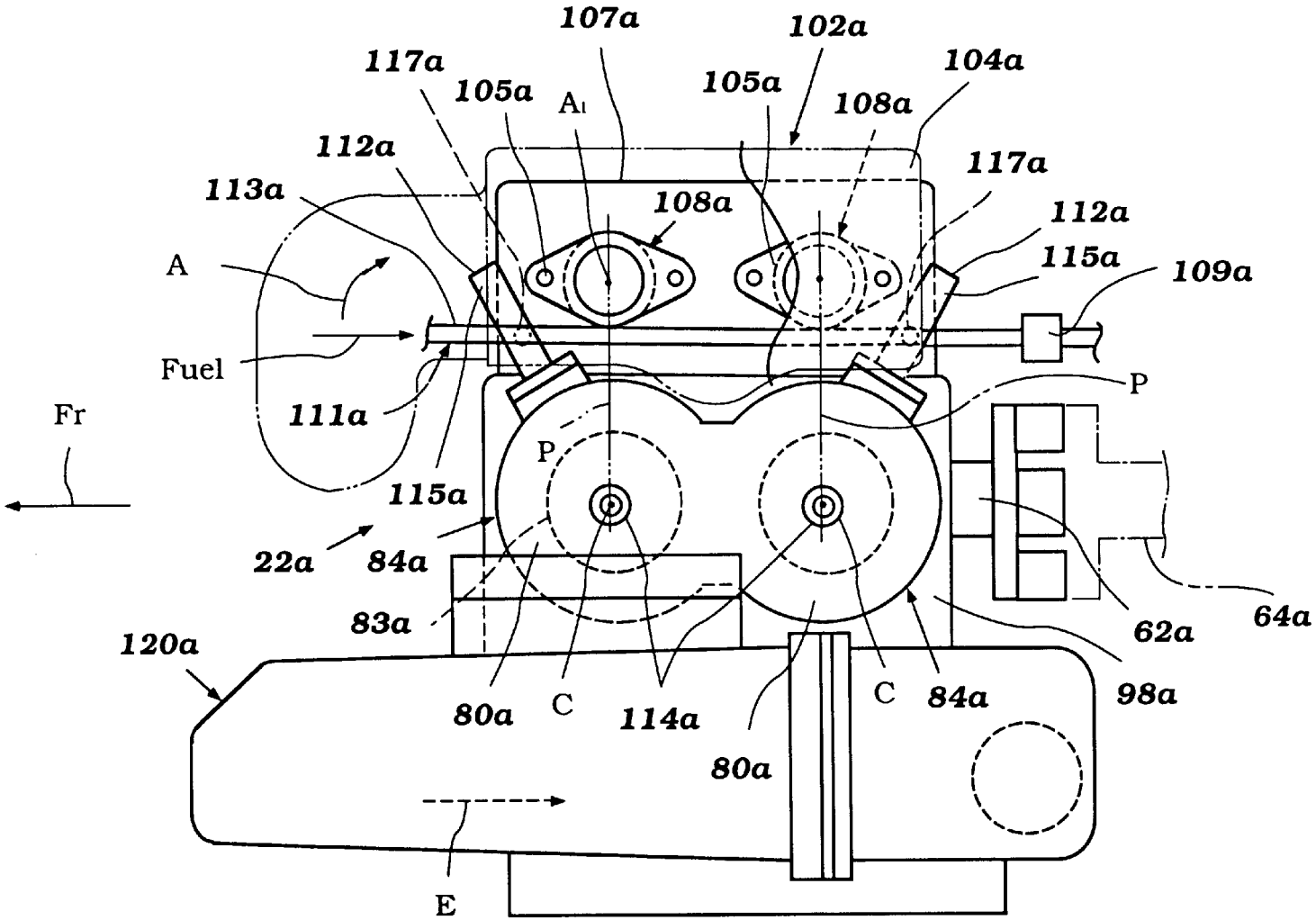
FIG. 4 is a top plan view of an engine which can be used with a small watercraft and which is configured in accordance with an additional embodiment of the present invention, and illustrates the engine with a portion of an intake silencer broken away to expose the relative positions of fuel injectors and intake pipes of the engine.

FIG. 4 illustrates an additional embodiment of the present engine design. In this embodiment, the components of the engine housing the fuel supply system and the exhaust system are substantially identical to those components of the above-described embodiment. Accordingly, like reference numerals with an "a" suffix have been used to designate like components between the embodiments. The principal difference between the embodiments lies in the configuration of the induction system.

As seen in FIG. 4, the intake silencer 104*a* includes a downwardly facing intake opening formed on a front side of the intake silencer 104*a*. The front portion of the intake silencer 104*a* extends toward the center of the engine 22*a* in order to increase the opening size.

The induction system also includes a plurality of intake pipes 105*a* that correspond to the number of cylinders 84*a* of the engine. In the illustrated embodiment, in which the engine comprises two cylinders 84*a*, the induction system includes two parallel intake pipes 105*a*. Each intake pipe 105*a* communicates with the plenum of the intake silencer 104*a* and extends between the intake silencer 104*a* and an inlet of the corresponding intake passage formed in the intake manifold 107*a*.

The flow axis $A_1$, of each intake pipe 105*a*, and thus the position of the corresponding throttle valve 108*a*, desirably falls within the corresponding vertical plane P that also contains the axis C of the respective cylinder 84*a*. In addition, the intake pipes 105*a* and the corresponding throttle valves 108*a* are located closer to the rotational axis of the crankshaft 62*a* than in the previous embodiment. That is, the intake pipes 105*a* and the corresponding throttle valves 108*a* lie further within the valley formed between the fuel injectors 112*a*. But like the previous embodiment, at least a portion of each intake pipe 105*a* lies between an imaginary line that extends between the outer influent ends 115 of the fuel injectors 112, which line lies parallel to the crankshaft axis. Again, by moving the intake pipes 105*a* and throttle valves 108*a* closer to the rotational axis of the crankshaft 62*a*, the lateral width of the engine 22*a* is reduced.

In this position, the fuel injectors 112*a* remain shielded from the access opening 60*a* by intake silencer cover 104*a*. In addition, the fuel injectors lie on a side of the rotational axis of the crankshaft 62*a* opposite of the side on which the exhaust system 120*a* lies. In this manner, the heat produced by the exhaust system has a lesser affect on the fuel within the fuel supply system 111*a* than if these components were located closer together.

Figure 5:
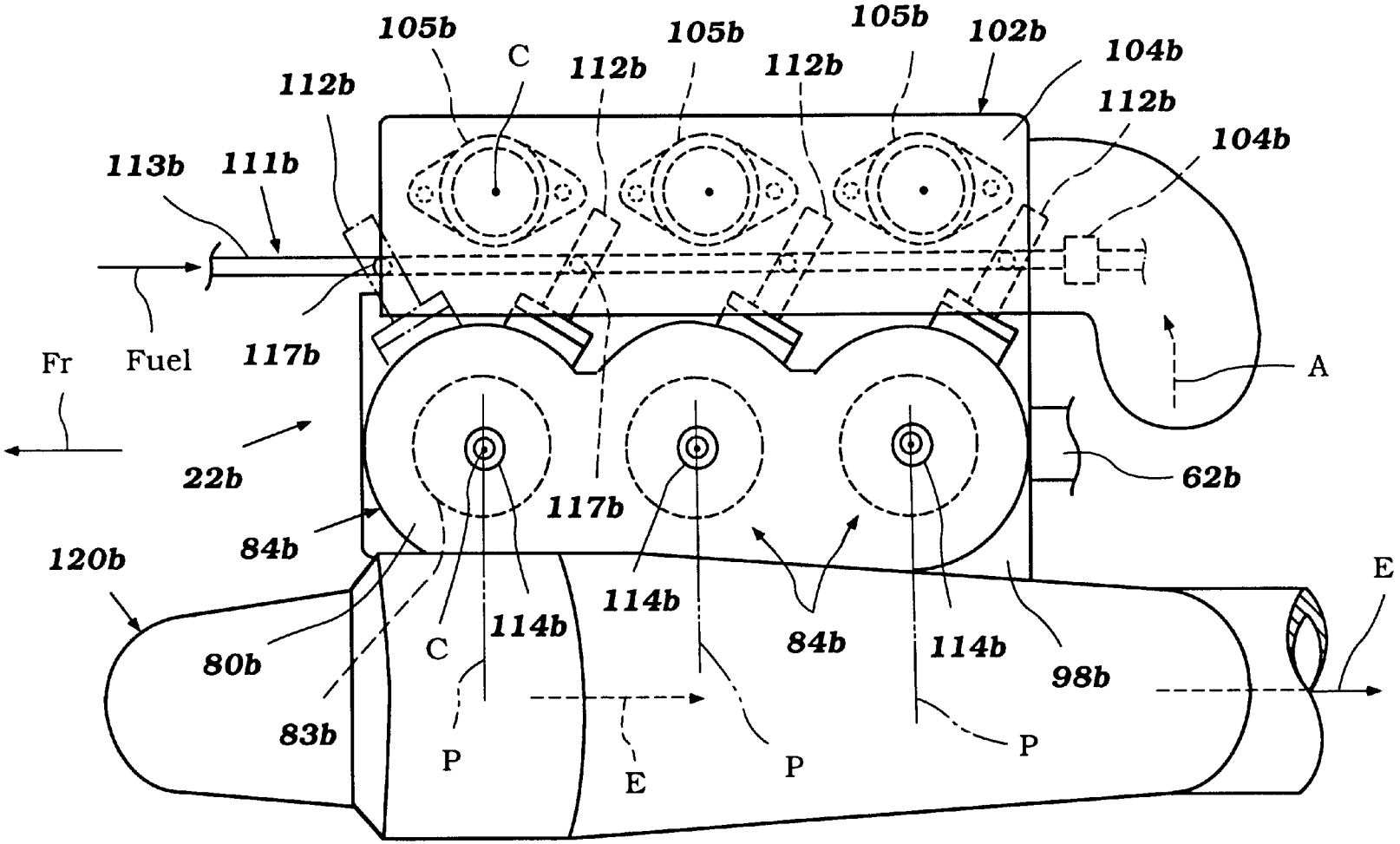
FIG. 5 is a top plan view of an engine which can be used with a small watercraft and which is configured in accordance with another embodiment of the present invention.

FIG. 5 illustrates another embodiment of the present engine 22. In this embodiment, the above principals of the component arrangement have been incorporated into an engine including three in-line cylinders. This embodiment is substantially similar to the above-described embodiments, and therefore, like reference numerals with a "b" suffix have been used to indicate similar components between the embodiments.

In the illustrated embodiment, the fuel injectors 112*b* are arranged so as to lie in a skewed orientation relative to their respective longitudinal vertical planes p. The angular orientation of each fuel injector 112*b* desirably is the same relative to the respective plane P. In this manner, the fuel injectors 112*b* lie generally parallel to each other, as seen in FIG. 5. However, it is understood that the fuel injector 112*b* associated with one of the end cylinders could be moved to an opposite side of the corresponding plane P and still achieve the above-noted advantages associated with this engine configuration.

Figure 6:
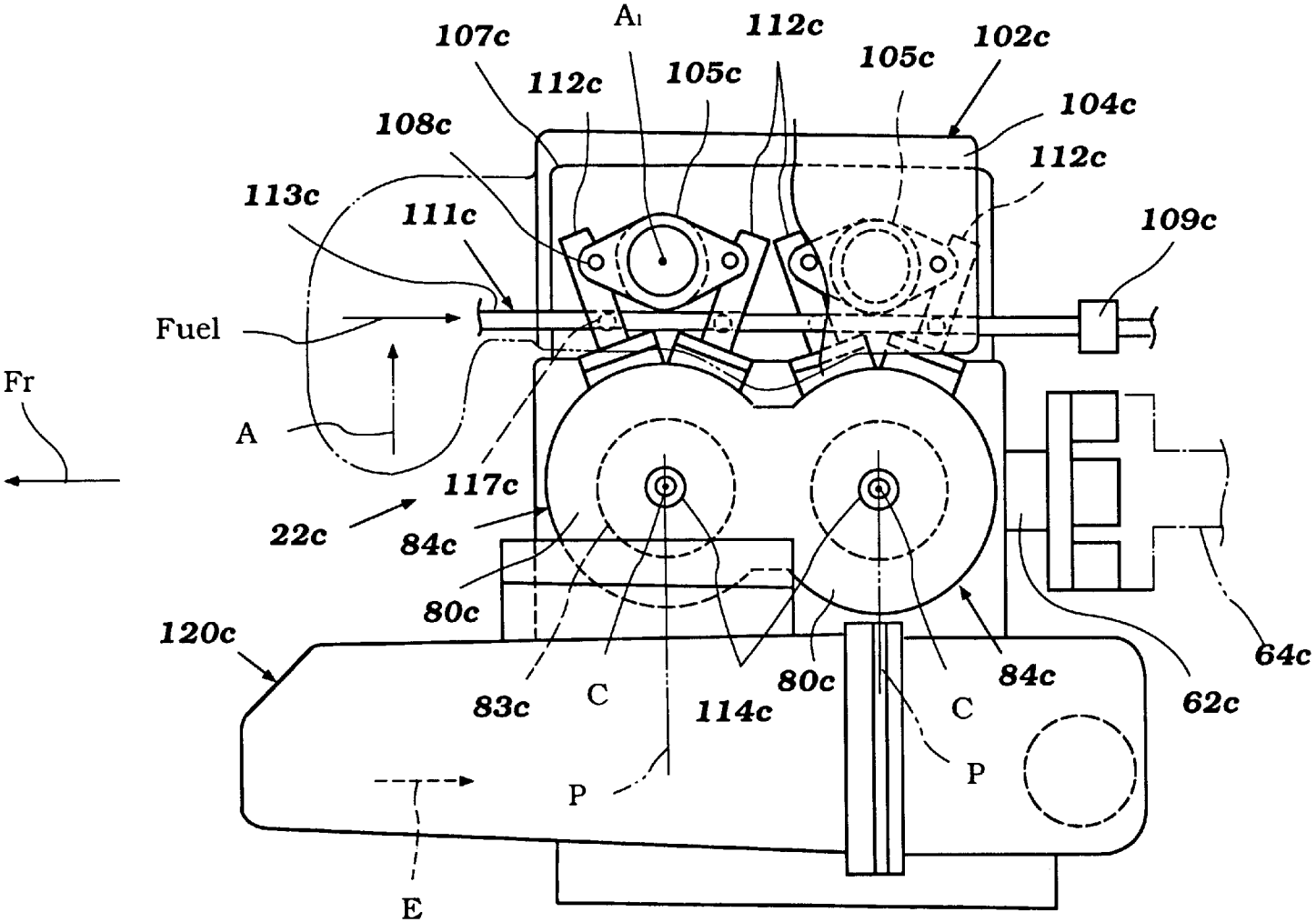
FIG. 6 is a top plan view of an engine which can be used with a small watercraft and which is configured in accordance with an additional embodiment of the present invention.

FIG. 6 illustrates a further embodiment of the present engine. Again, the engine block assembly and the exhaust system are substantially similar to the embodiments described above, and therefore, like reference numerals with a "c" suffix have been used to indicate similar components between the various embodiments.

As seen in FIG. 6, the fuel supply system 111*c* includes a fuel rail 113*c* that delivers fuel to a plurality of fuel injectors 112*c*. In this embodiment, each cylinder 84*c* includes two fuel injectors 112*c* so as to increase the output power of the engine 22*c*. Each cylinder of the pair of cylinders is skewed relative to a respective vertical longitudinal plane P so as to define a valley between the fuel injectors 112*c* of the pair. The oblique angular relationship between each fuel injector 112*c* and the respective plane P desirably is the same for each fuel injector 112*c*. That is, the fuel injectors 112*c* of the pair are arranged such that the plane P bifurcates the valley defined between the two fuel injectors 112*c*.

The fuel rail 113*c* is also arranged closer to the rotational axis of the crankshaft 62*c* than in the previous embodiments. In this manner, more space is defined between the corresponding pairs of fuel injectors 112*c*.

The intake pipes 105*c* are arranged to lie within the valleys defined between the fuel injectors 112*c*. That is, for each cylinder 84*c*, one intake pipe 105*c* depends downward between the influent ends 115*a* of the corresponding pair of fuel injectors 112*c* and communicates with an inlet of a corresponding intake passage within the manifold 107*c*. The corresponding throttle device 108*c* lies above the influent ends of the respective fuel injectors 112*c*.

As also seen in FIG. 6, the intake silencer cover 104*c* covers at least portions of each of the cylinder pairs 112*c*. The intake silencer 104*c* also includes a downwardly facing inlet opening which lies on the front side of the engine 22*c*.

In this manner, the engine maintains a compact configuration while obtaining the advantages associated with employing two fuel injectors per cylinder. In addition, the location of the fuel injectors shields the fuel injectors from water that may enter through the access opening, and also separates the fuel injectors and fuel rail from the exhaust system 120*c*.

Figure 7:
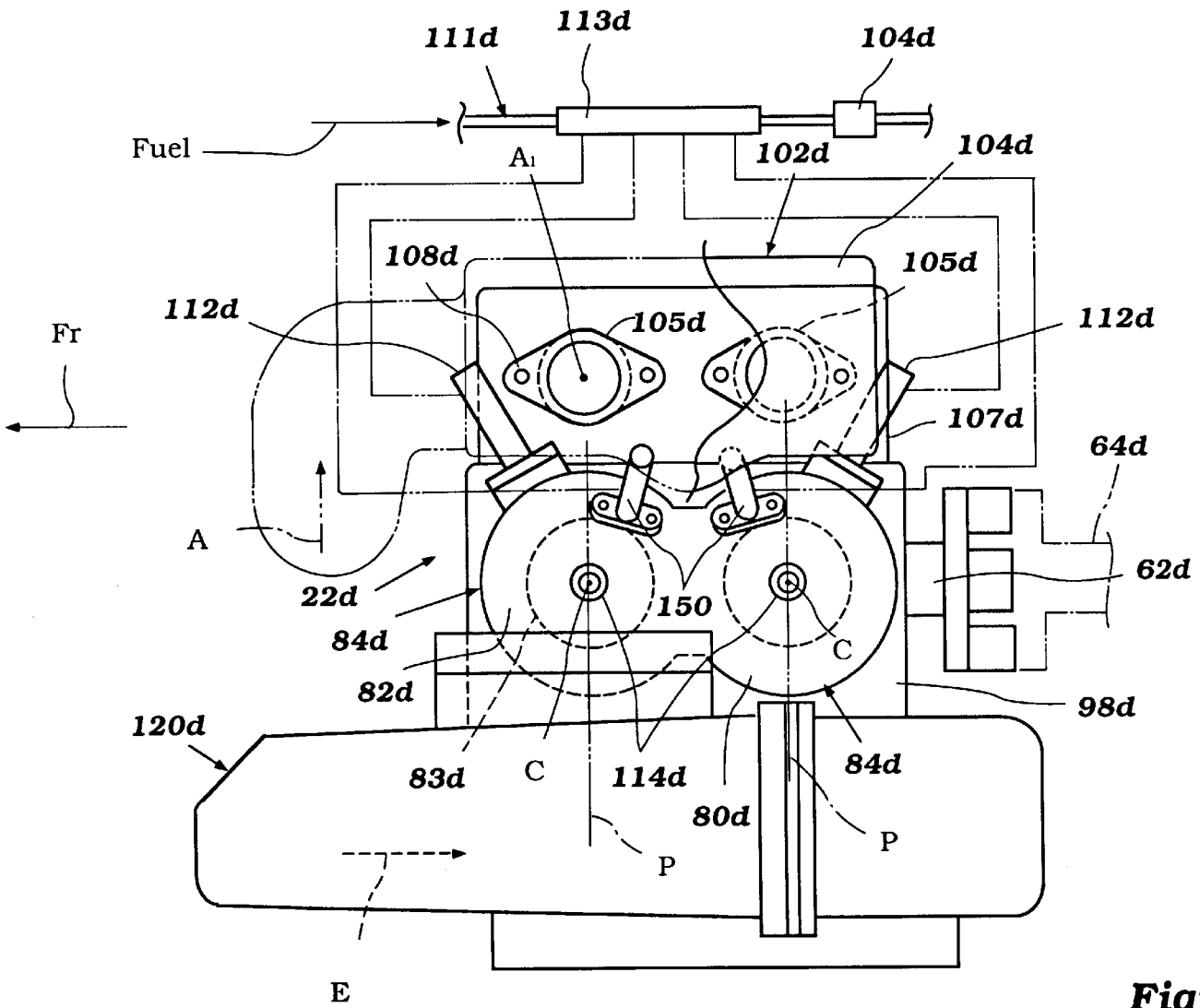
FIG. 7 is a top plan view of an engine which can be used with a small watercraft and which is configured in accordance with a further embodiment of the present invention.

FIG. 7 illustrates another embodiment of the present engine which employs a plurality of fuel injectors with each cylinder of the engine. In the illustrated embodiment, the engine block assembly and the exhaust system are substantially identical to that described above. Accordingly, like reference numerals with a "d" suffix have been used to indicate the similarity of these components, as well as others, between the embodiments.

The general arrangement of the induction system 102*d* and the fuel injectors 112*d* is substantially similar to that described above in connection with FIG. 4. However, in this embodiment, the fuel supply system 111*d* also includes two additional fuel injectors 150.

Each fuel injector is mounted onto the top of a corresponding cylinder head 82*d* and communicates with one of the combustion chambers 83*d*. The fuel injectors 150 are skewed relative to the respective lateral, vertical plane P, as well as are upwardly angled beneath the intake silencer cover 104*d*. In this position, the fuel injectors 150, in addition to the side mounted fuel injectors 112*d*, at least lie partially beneath the intake silencer cover 104*d* for the protective purposes noted above. In addition, this arrangement provides dual fuel injectors per cylinder without significantly increasing the width of the engine. The arrangement of the fuel injectors also reduces the affect of the high operating temperature of the exhaust system 120*d* on the fuel injectors and the associated fuel supply system.

The fuel supply system 111*d* includes a fuel rail 113*d*. Individual delivery lines extend between the fuel rail 113*d* and each fuel injector 112*d*, 150. Also, while the fuel supply system is schematically illustrated in FIG. 7, it should be understood that the fuel rail 113*d* desirably lies as close to the fuel injectors as possible so as to minimize the length of the delivery lines.

Figure 8:
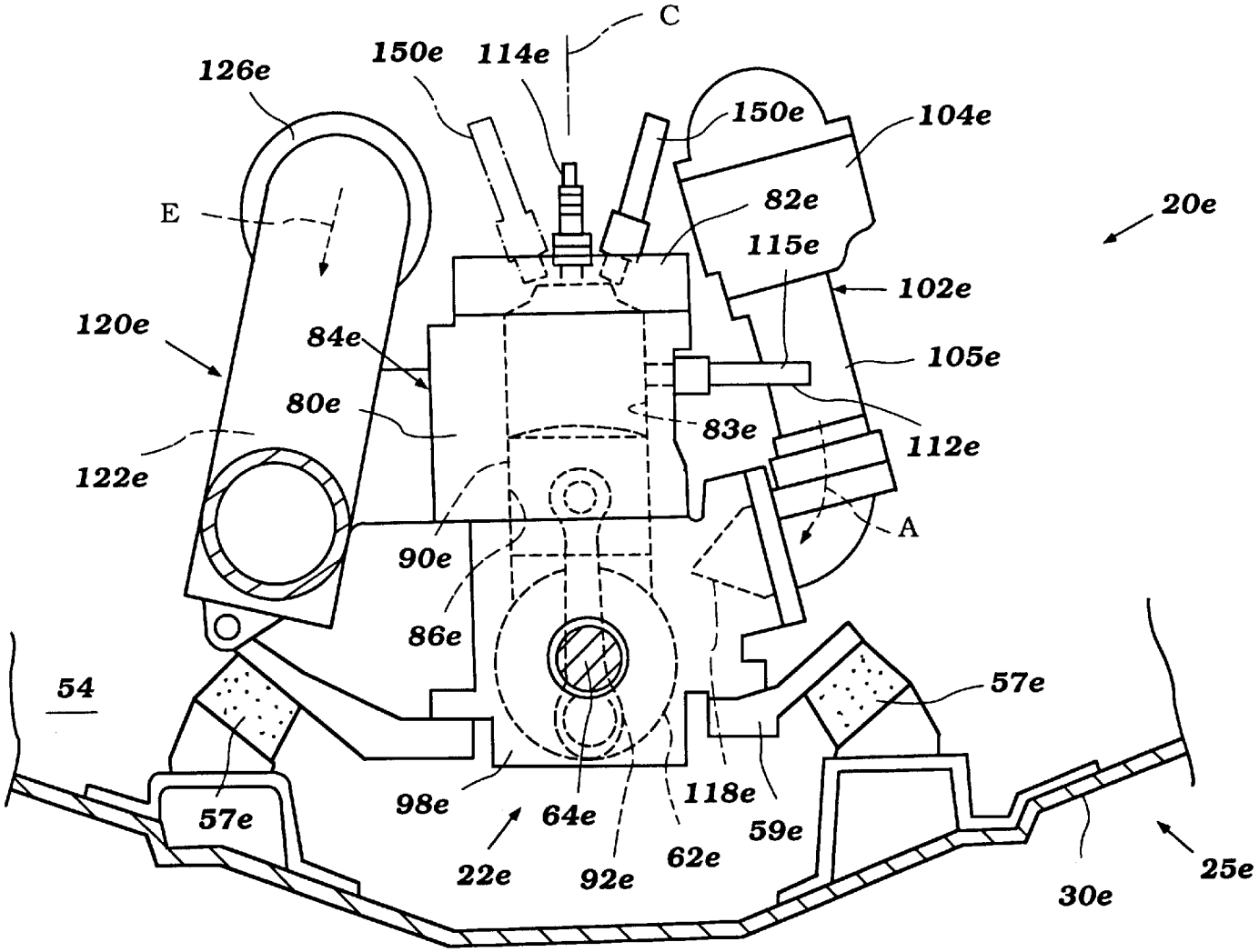
FIG. 8 is a front elevational view of an engine which can be used with a small watercraft and which is configured in accordance with another embodiment of the present invention.

FIG. 8 illustrates an additional embodiment of an engine employing dual fuel injectors per cylinder. Because the basic construction of the engine is substantially similar to that described in connection with the previously described embodiments, like reference numerals with an "e" suffix have been used to indicate similar components between the embodiments.

As seen in FIG. 8, the induction system was arranged such that an access through the intake pipe 105*e* is skewed relative to the axis C of the respective cylinder 84*e*. The upper end of the intake pipe 105*e* lies closer to axis C than does the bottom end of the intake pipe 105*e*. The lower end of the intake pipe 105*e* is connected to an inlet port of the intake manifold. A reed valve 118*e* selectively controls the influx of the air charge into the respective crankcase chamber. The intake air silencer 104*e* is positioned on top of the intake pipe 105*e* and extends only slightly over the cylinder head 82*e*.

On the opposite side of the cylinder block lies the exhaust system 120*e*. The exhaust pipe 122*e* extends upwardly from the cylinder block 80*e* and is slightly canted towards a longitudinally extending vertical axis which contains the axis C of the cylinder 84*e*. So positioned, the exhaust chamber 126 lies slightly above and next to the cylinder head 82*e*.

The fuel supply system includes the dual fuel injectors 112*e*, 150*e*. The first fuel injector 112*e* is mounted to the side of the cylinder block 80*e* and communicates with the combustion chamber 83*e*. In this position, the influent end 115*e* of the fuel injector 112*e* lies next to the intake pipe 105*e* and beneath the intake silencer 104*e*. In this position, the fuel injector 112*e* also lies on a side of the cylinder block 80*e* opposite the exhaust system 120*e*.

The second fuel injector 150*e* is mounted in the cylinder head 82*e* next to the spark plug 114*e*, in the space defined between the exhaust chamber 126*e* and the intake silencer 104*e*. The fuel injector 150*e* desirably lies to a side of the longitudinally extending vertical plane which contains axis C opposite that of the exhaust chamber 126*e* and next to the intake silencer 104*e*. In this position, at least a portion of the air flow intake into the intake silencer 104*e* flows across the fuel injector 150*e* to provide cooling. Accordingly, the second fuel injector 150*e* can also be located next to the exhaust chamber 126*e*; however, this position is less desirable because of the thermal heating effect associated with the fuel injector 150*e* being located in close proximity to the exhaust system 120*e*.

As appreciated from FIG. 8, this engine configuration provides a compact engine structure while providing the advantages associated with dual fuel injection per cylinder. The engine 22*e* also provides the advantage of shielding at least the first fuel injectors 112*e* which are located beneath the intake silencer 104*e*. And the location of the fuel injectors 112*e* and 150*e* on a side of the longitudinally extending vertical plane which contains axis C is a position on the opposite side of the exhaust system 120*e*, reduces the thermal effects that the exhaust system 120*e* has on the fuel supply and injection system.

Figure 9:
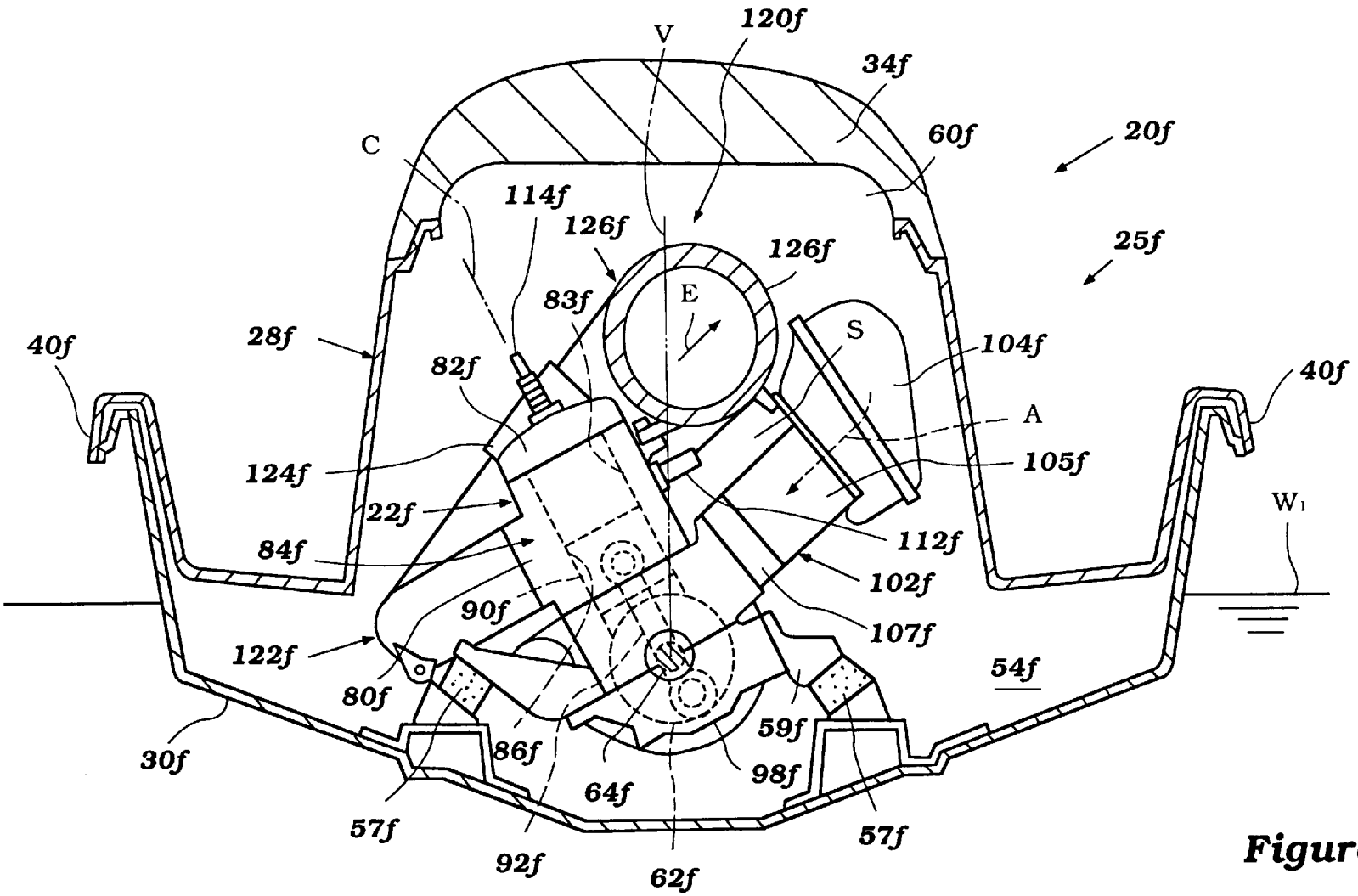
FIG. 9 is a cross-sectional view of a watercraft hull that contains an engine which is configured in accordance with an additional embodiment of the present invention.

FIG. 9 illustrates an engine configured in accordance with another preferred embodiment of the present invention. Again, like reference numerals with an "f" suffix have been used to indicate like components between the embodiments.

As understood from FIG. 9, the cylinders 84*f* have an inclined orientation relative to a central vertical plane V that extends longitudinally along the watercraft body 25*f*. That is, the axis C of the cylinder lies at an oblique angle relative to the central plane V. As noted above, this inclined orientation of the cylinders 84*f* reduces the height of the engine without sacrificing engine displacement. The cylinder block 80*f*, bore 86*f*, crankcase 98*f*, crankshaft 62*f*, connecting rod 92*f* and piston 90*f* otherwise have a similar configuration to the like components described above.

Each fuel injector 112*f* is connected to an upper side of the respective cylinder 84*f*. The injector communicates with corresponding combustion chamber 83*f* defined at least in part within the cylinder 84*f*.

The induction system 102*f* also is connected to the upper side of the cylinder block assembly 80*f*. In the illustrated embodiment, the induction system includes an intake silencer 104*f* that is positioned to one side of the engine 22*f*. The intake silencer 104*f* communicates with an intake pipe 105*f* and is attached to the intake manifold 107*f* that is connected to the cylinder block assembly 80*f*. The intake pipe 105*f* communicates with the corresponding crankcase chamber through an intake passage within the intake manifold 107*f* and through a reed valve (not shown) which selectively permits the flow of intake air into the corresponding crankcase chamber.

The exhaust system 120*f* is connected to a lower side of the cylinder 84*f*. That is, the exhaust system communicates with an exhaust port which is formed on a side of the cylinder block 80*f* opposite the side on which the induction system 102*f* and the fuel injector 112*f* are connected. In particular, an exhaust pipe 122*f* is connected to the exhaust port on the cylinder block 80*f*. The exhaust pipe 122*f* wraps around on the front side of the engine 22*f*. The expansion pipe 126*f* is connected to the upper end of the exhaust pipe 122*f* by an expansion joint 124*f*. The expansion pipe 126*f* extends upwardly to at least partially cross over the vertical plane V and then extends in a direction generally parallel to the rotational axis of the crankshaft 62*f*. Along this length, the expansion chamber extends above and over at least a portion of the fuel injectors 112*f* and the intake pipes 105*f*. As seen in FIG. 9, a space S is defined between the induction system 102*f* and the exhaust chamber 126*f*. It is in this space that the fuel injectors 122*f* are located. In this position, the fuel injectors are shielded from water that may enter into the engine compartment 54*f* through the upper access opening 60*f*. The fuel injectors 112*f* also do not interfere with the position of the exhaust system 120*f* or the induction system 102*f* by being arranged within this space s.

Figure 10:
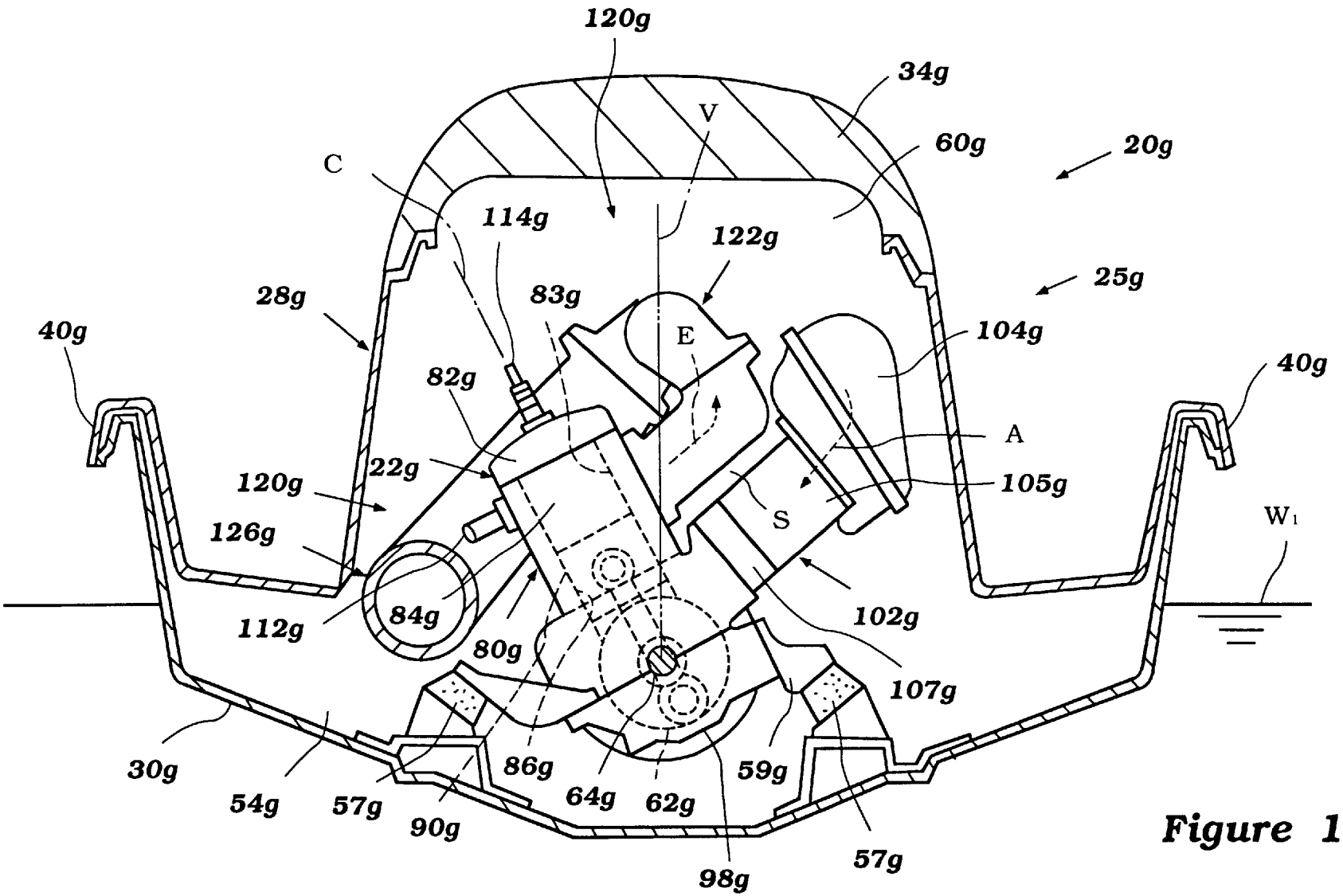
FIG. 10 is a cross-sectional view of a watercraft hull that contains an engine which is configured in accordance with a further embodiment of the present invention.

FIG. 10 illustrates a further preferred embodiment of the present engine design which is substantially similar to the embodiment illustrated in FIG. 9, except for the construction of the exhaust system and the positioning of the fuel injector. Accordingly, like reference numbers with a "g" suffix have been used to indicate similar components between these embodiments.

As understood from FIG. 10, the exhaust system 120*g* includes an exhaust pipe 122*g* that is attached to the upper surface of the cylinder body 80*g*. In this position, the exhaust pipe 122*g* lies in close proximity to the intake pipe 105*g*. Only a small space S exists between these intake and exhaust pipes 105*g*, 122*g*, which lie generally parallel to one another at this location. The exhaust pipe 122*g* then extends upwardly and forwardly and terminates at a downwardly facing flange. The flange mates with a corresponding flange of the exhaust chamber 126*g*. The exhaust chamber extends around the front side of the engine 22*g* and wraps down on the underside of the cylinder block 80*g*. The exhaust chamber 126*g* extends along the underside of the engine generally parallel to the axis of the crankshaft 62*g*.

As seen in FIG. 10, the fuel injector 112*g* of each cylinder 84*g* is connected to a lower side of the cylinder block 80*g*. The fuel injector 112*g* is located within a space that exists between the lower side of the cylinder block 80*g* and the exhaust chamber 126*g*. In this position, the cylinder block 80*g* and cylinder head 82*g* cover at least a portion of the fuel injector so as to at least partially shield the fuel injector 112*g* from water that may enter through the access opening 60*g*. In addition, by locating the fuel injector 112*g* within this space, the fuel injector may be positioned on the cylinder block without interfering with the position of the exhaust system 120*g* and the induction system 102*g*.

Figure 11:
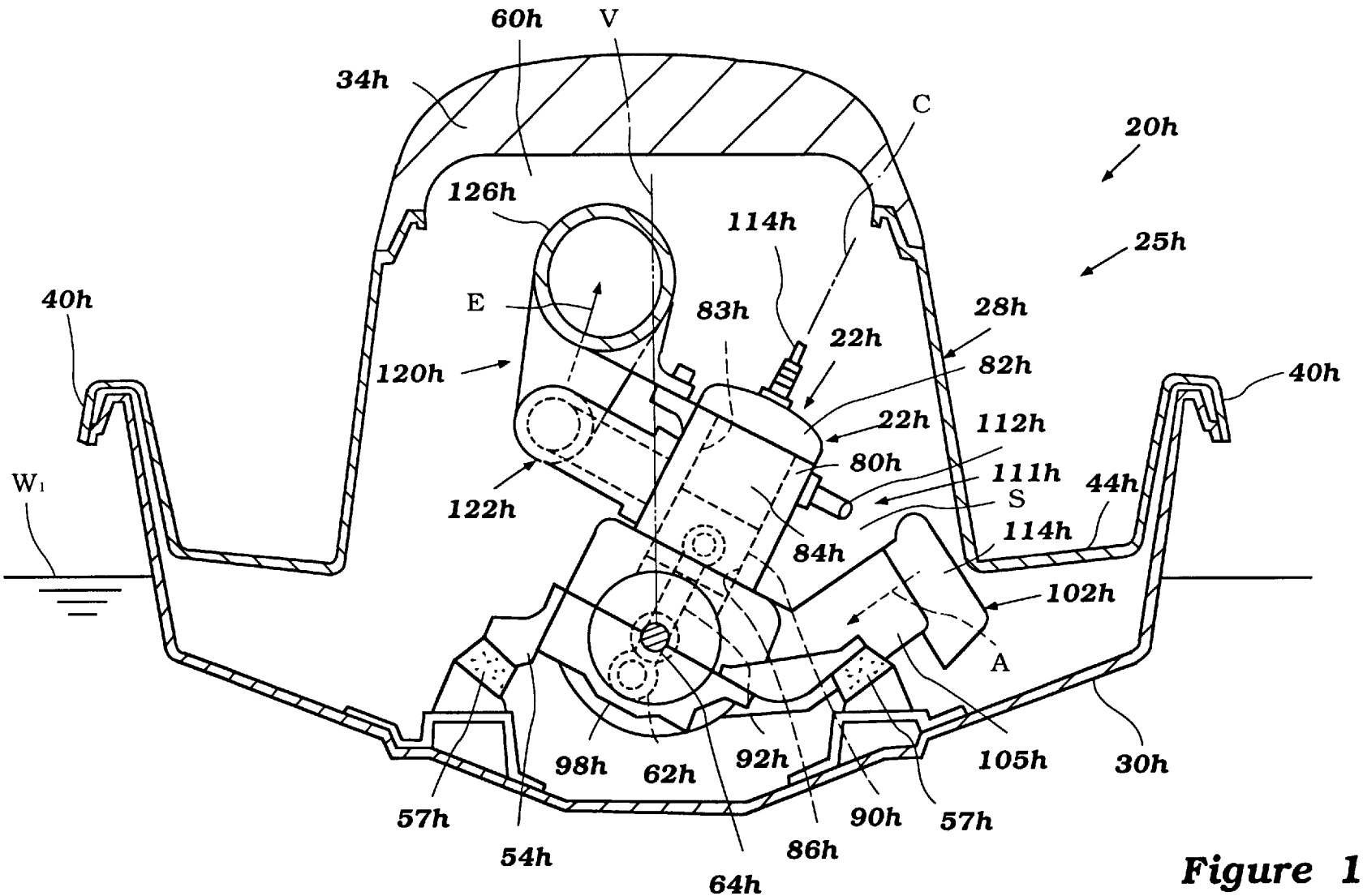
FIG. 11 is a cross-sectional view of a watercraft hull that contains an engine which is configured in accordance with another embodiment of the present invention.

FIG. 11 shows an additional embodiment of the present engine design. In this embodiment, the cylinder has an inclined orientation, similar to those illustrated in FIGS. 9 and 10, but is inclined to an opposite side of the vertical longitudinal axis V. That is, the cylinder 84*h* extends upwardly from the crankcase 98*h* in an inclined manner toward the starboard side of the watercraft. In view of the similarities between these embodiments, like reference numerals with an "h" suffix have been used to designate similar components between these embodiments.

As seen in FIG. 11, the induction system 102*h* is attached to a lower side of the cylinder block assembly 80*h*. An intake silencer 114*h* is positioned within the watercraft hull 25*h* at a point near the foot well 44*h* on the starboard side of the watercraft 20*h*. An intake pipe 105*h* connects the intake silencer to an intake manifold of the cylinder block assembly 80*h*. The intake pipe 105*h* selectively communicates with a crankcase chamber within the crankcase 90*h* of the engine through a reed valve (not shown). As seen in FIG. 11, the airflow passed through the intake pipe 105*h* is generally parallel to the dead rise angle of the hull lower portion 30*h*.

The fuel injector 112*h* also is attached to a lower side of the cylinder block assembly 80*h*. The fuel injector 112*h* is positioned within a space S or valley s defined between the cylinder block 80*h* and the intake pipe 105*h*. In this position, the fuel injector 112*h* does not increase the width of the engine, and does not interfere with the position of the intake pipe 105*h*. In addition, the cylinder head 82*h* and a cylinder block 80*h* extend above at least a portion of the fuel injector 112*h*. In this position, these engine components 80*h*, 82*h* shield at least a portion of the fuel injector 112*h* from any water that may enter through the access opening 60*h* above the engine 22*h*.

The exhaust system is connected to the cylinder block assembly 80*h* on the opposite side of the cylinder block 80*h*. The exhaust pipe 122*h* of the exhaust system 120*h* is connected to the cylinder block and extends forwardly to the front side of the engine. At this point, the exhaust pipe turns upwardly and is connected to a downward facing opening of the exhaust chamber 126*h*. The exhaust chamber 126*h* wraps rearwardly and extends at an elevated position above and next to the cylinder head 82*h* of the engine 22*h*. The exhaust chamber 126*h* desirably extends in a direction generally parallel to the rotational axis of the crankshaft 62*h*. As seen in FIG. 11, the majority of the exhaust system lies on a side of the vertical central plane V opposite of the side on which the induction system 102*h* and the fuel injectors 112*h* lie. As a result, in this position, the injectors 112*h* are protected from the heat radiated from the exhaust chamber 126*h* because the injectors are spaced some distance therefrom. Accordingly, the injectors 112*h* and the corresponding fuel supply system 11 lh do not experience the thermal effects associated with the elevated operating temperature of the exhaust system 120*h* when significantly spaced apart, as provided by this embodiment.

Figure 12:
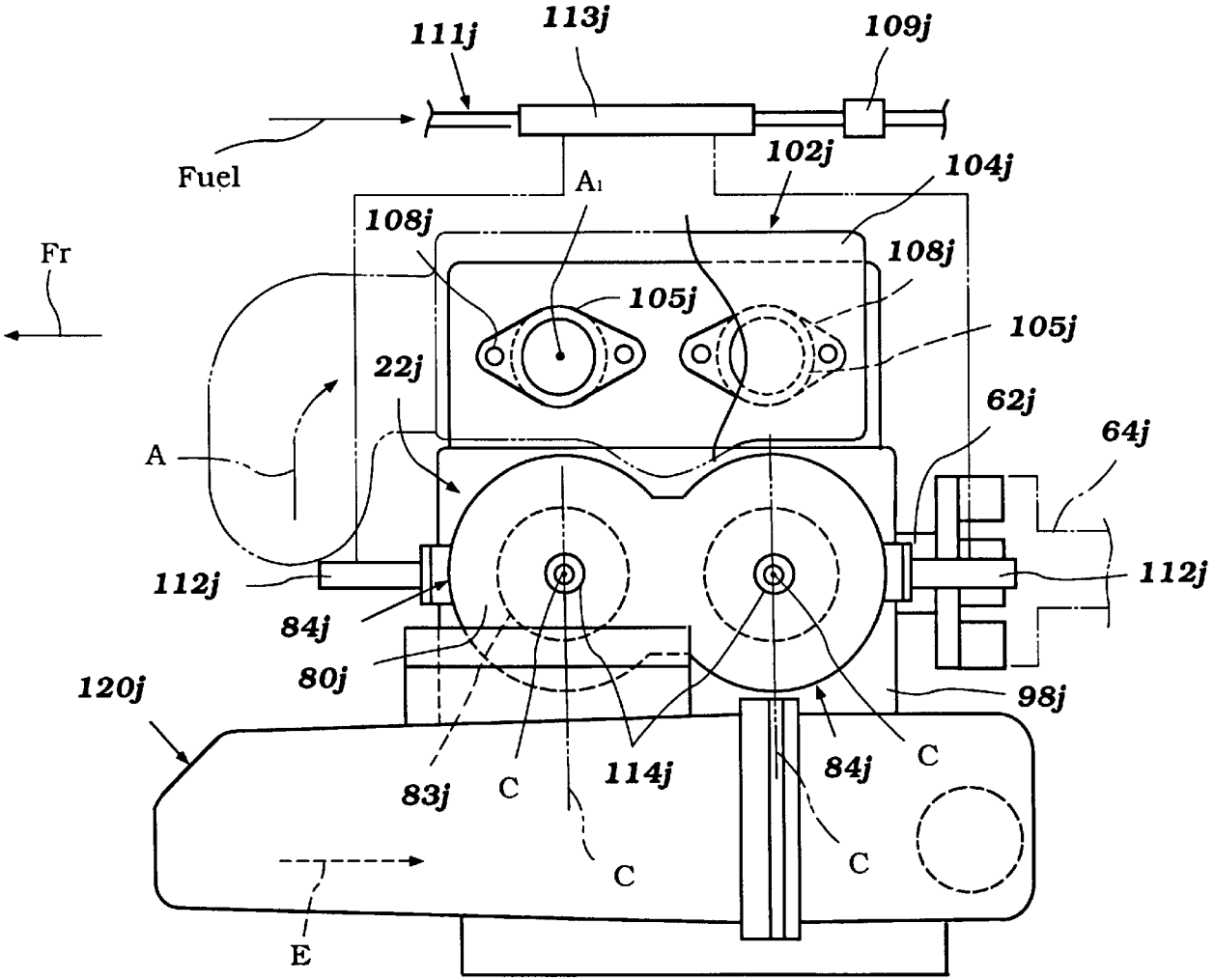
FIG. 12 is a top plan view of an engine which can be used with a small watercraft and which is configured in accordance with a further embodiment of the present invention.

FIG. 12 illustrates a further embodiment of the present engine design, and is substantially similar to the embodiment illustrated in FIG. 4, except for the arrangement of the fuel injectors and the associated fuel supply system. Accordingly, like reference numerals with a "j" suffix have been used to indicate similar components between these two embodiments.

As seen in FIG. 12, the fuel injectors are connected to the longitudinal surfaces of the corresponding cylinders 84*j*. That is, the injectors 112*j* are connected to surfaces that lie generally normal to and are spaced apart from one another along a longitudinal axis of the watercraft. In the illustrated embodiment, the fuel injectors 112*j* are arranged to lie generally parallel to the rotational axis of the crankshaft 62*j* on front and rear ends of the engine 22 (i.e., on opposite longitudinal sides of the engine). The intake system 102*j* and the exhaust system 120*j* are connected to lateral sides of the first cylinder on opposite sides of the longitudinal axis relative to each other. With this engine component arrangement, the fuel injectors 112*j* do not interfere with the arrangement of the induction system 102*j* and the exhaust 120*j*. In addition, the fuel injectors 112*j* are distanced from the exhaust system 120*j* so as to reduce the thermal effects therefrom.

The fuel supply system 111*j* includes a fuel rail 113*j* which supplies fuel to each of the injectors 112*j* through dedicated delivery lines. Although the fuel supply system 111*j* is schematically illustrated in FIG. 12, it is desired that the fuel rail 113*j* be positioned in a close proximity to the fuel injectors 112*j* so as to minimize the length of the delivery lines.

Figure 13:
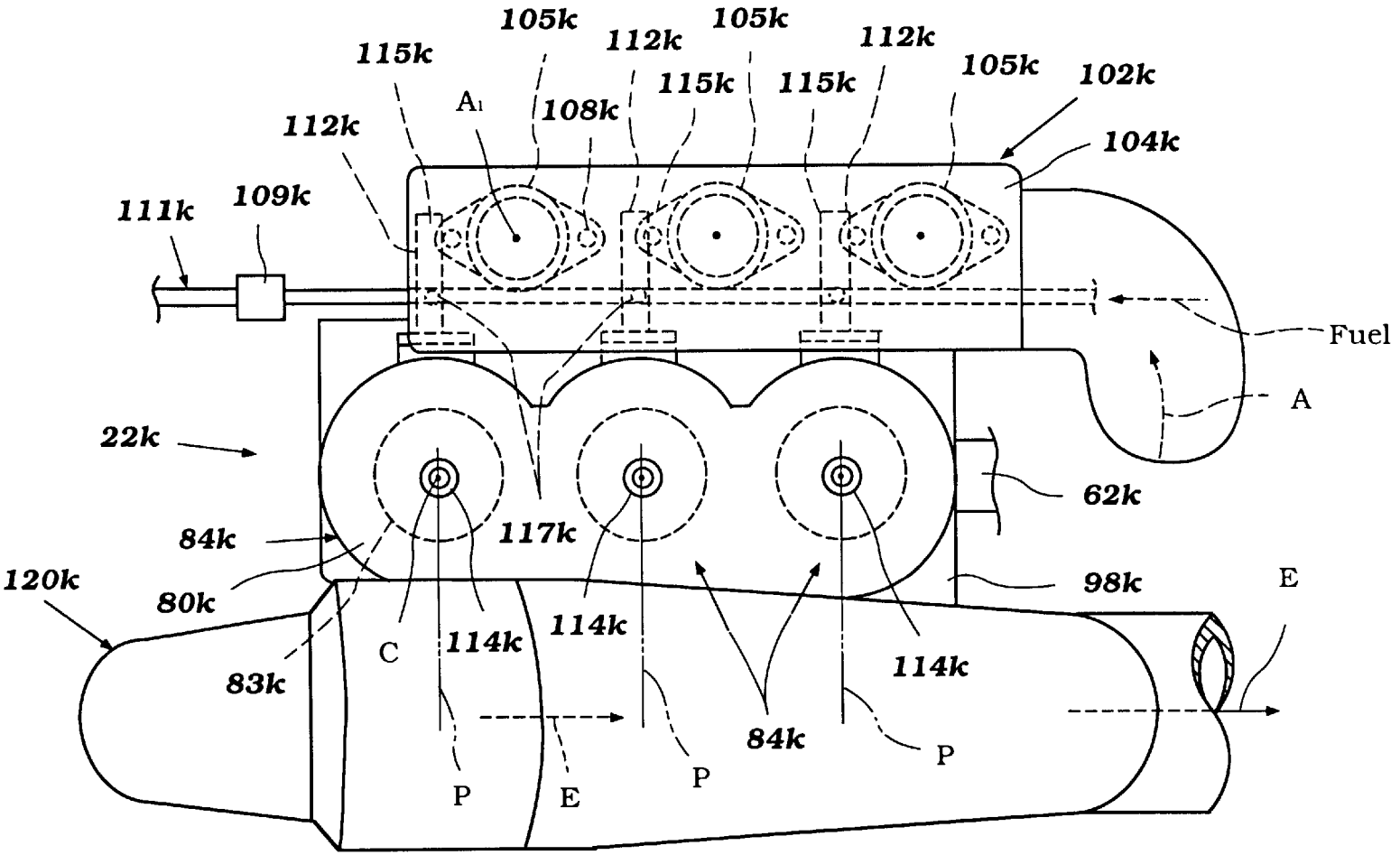
FIG. 13 is a top plan view of an engine which can be used with a small watercraft and which is configured in accordance with another embodiment of the present invention.

FIG. 13 illustrates an additional embodiment of a configuration similar to that illustrated in FIG. 5, with the exception of the arrangement of the fuel injectors and the position of the intake pipes. For this reason, like reference numerals with a "k" suffix have been used to indicate similar components between these embodiments.

As seen in FIG. 13, each fuel injector 112*k* lies generally parallel to and desirably within a longitudinally extending vertical plane P that also contains the axis C of the respective cylinder 84*k*. The corresponding intake pipe 105*k*, however, is offset relative to the corresponding longitudinally extending vertical plane P. As a result, at least one intake pipe 105*k* extends at least partially between the influent end 115*k* of two adjacent fuel injectors 112*k*.

This engine configuration offers the above-noted advantages of positioning the fuel injectors at least partially beneath the intake silencer cover 104*k* so as to shield the fuel injectors at least partially from any water which may enter through the access opening above the engine 22*k*. In addition, the relative arrangement between the fuel injectors 112*k* and the intake pipes 105*k* reduces the distance between the intake pipes 105*k* and a rotational axis of the crankshaft 62*k*, so as to reduce the width of the engine 22*k*. In addition, the fuel injectors 112*k* are remotely positioned relative to the exhaust system 120*k*. That is, in the illustrated embodiment, the fuel injectors 112*k* and the exhaust system 120*k* lie on diametrically opposite sides of the cylinder bank from each other. As a result, thermal heating of the fuel within the fuel injectors 112*k* and the fuel supply system 111*k* due to the operating temperature of the exhaust system 120*k* is minimized.

Although this invention has been described in terms of a certain preferred embodiment, other embodiments apparent to those of ordinary skill in the art are also within the scope of this invention. For instance, as will be readily apparent to those skilled in the art, certain aspects of each embodiment can be combined with other embodiments. For instance, the position of the fuel injectors relative to the water level when the watercraft floats upright and inverted can be incorporated into many of the illustrated embodiments in addition to the embodiment illustrated in FIGS. 1–3. In addition, many of the above described component arrangements can be employed with inclined as well as upright cylinder banks. Accordingly, the scope of the invention is intended to be defined only by the claims that follow.

What is claimed is:

1. A watercraft comprising a hull defining an engine compartment, an internal combustion engine positioned within the engine compartment, the engine including at least one combustion chamber, an intake system that provides air to said at least one combustion chamber, and a fuel system that provides fuel to said at least one combustion chamber, said intake system including an intake silencer and said fuel system including at least one fuel injector, said fuel injector being arranged on said engine such that said intake silencer extends directly over at least a portion of said fuel injection so as to shield said fuel injector from water entering the hull through an access opening in the hull.

2. A watercraft as in claim 1, wherein said hull includes an access opening arranged above at least a portion of the engine, and at least a portion of said intake silencer lies between said access opening and at least said portion of said fuel injector.

3. A small watercraft as in claim 1, wherein said engine comprises at least one cylinder that forms at least a portion of said at least one combustion chamber, said cylinder having an inclined orientation relative to a vertical plane that extends along a longitudinal axis of the watercraft hull.

4. A watercraft as in claim 1, wherein said intake silencer extends over the entire fuel injector.

5. A small watercraft comprising a hull defining an engine compartment, an internal combustion engine positioned within the engine compartment, the engine including at least one combustion chamber and an intake system that provides air to said at least one combustion chamber, a fuel system including at least one fuel injector that provides fuel to said at least one combustion chamber, said at least one fuel injector being positioned within the hull so as to be above the water surface level of the body of water in which the watercraft is operated with the hull floating in a normal upright position and with the hull floating in an inverted position, and a propulsion device driven by said engine.

6. A small watercraft as in claim 5, wherein said engine comprises at least one cylinder that forms at least a portion of said at least one combustion chamber, said cylinder having an inclined orientation relative to a vertical plane that extends along a longitudinal axis of the watercraft hull.

7. An internal combustion engine for a small watercraft comprising a crankshaft journalled to rotate about a first axis within a crankcase, at least one cylinder extending upwardly from the crankcase, said at least one cylinder forming at least a portion of a combustion chamber of said engine, an intake system including at least one intake pipe that provides air to said at least one cylinder, and a fuel system including at least one fuel injector that provides fuel to said at least one combustion chamber, said fuel injector lying in a skewed orientation relative to a plane that extends generally normal to the first axis and includes an axis of said at least one cylinder, said fuel injector including an influent end and an effluent end that communicates with said at least one combustion chamber, said intake pipe being arranged on said engine such that at least part of the intake pipe is closer to said first axis than is the influent end of the fuel injector.

8. An internal combustion engine as in claim 7 additionally comprising another cylinder that extends upwardly from the crankcase, said fuel supply system including another fuel injector that includes an influent end and an effluent end communicating with said another cylinder, said other fuel injector being skewed relative to a plane that lies generally normal to the first axis and contains an axis of said another cylinder, said fuel injectors being arranged on the engine such that a first distance between influent ends of the fuel injectors is different than a second distance between the effluent ends of the fuel injectors.

9. An internal combustion engine as in claim 8, wherein the fuel supply system includes a fuel rail connected to the influent end of each fuel injector, and the fuel rail lies generally parallel to the first axis about which the crankshaft rotates.

10. An internal combustion engine as in claim 8, wherein said first distance is greater than said second distance.

11. An internal combustion engine as in claim 7, wherein an influent end of the fuel injector lies closer to said plane than does said effluent end.

12. An internal combustion engine as in claim 11, wherein said intake pipe is arranged on the engine such that a flow axis of the intake pipe at an effluent end of the intake pipe lies on one side of said plane and the influent end of the fuel injector lies on the other side of the plane.

13. An internal combustion engine as in claim 7, wherein an effluent end of the fuel injector lies closer to said plane than does said influent end.

14. An internal combustion engine as in claim 13, wherein said intake pipe is arranged on the engine such that a flow axis of the intake pipe at an effluent end of the intake pipe lies on one side of said plane and the effluent end of the fuel injector lies on the other side of the plane.

15. An internal combustion engine as in claim 7, wherein said fuel supply system includes another fuel injector including an influent end and an effluent end communicating with said at least one cylinder, said fuel injectors being arranged on opposite sides of said plane.

16. An internal combustion engine as in claim 15, wherein said another fuel injector is skewed relative to said plane.

17. An internal combustion engine as in claim 7, wherein said fuel supply system includes another fuel injector communicating with said at least one combustion chamber, said fuel injector being mounted in a cylinder head of the engine which forms at least a portion of said at least one combustion chamber.

18. An internal combustion engine as in claim 7, wherein said at least one cylinder extends upward from the crankcase in an inclined fashion relative to a vertical plane that contains the first axis about which the crankshaft rotates.

19. An internal combustion engine for a small watercraft comprising an engine body defining a crankcase and at least one inclined cylinder extending upwardly in an inclined manner from the crankcase, said at least one cylinder forming at least a portion of a combustion chamber of said engine, a crankshaft journalled to rotate about a first axis within the crankcase, an intake system including at least one intake pipe that provides air to said at least one cylinder, and a fuel system including at least one intake pipe that provides air to said at least one cylinder, and a fuel system including at least one fuel injector that delivers fuel to said at least one combustion chamber, said fuel injector being directly connected to an upper surface of the inclined engine body and said intake pipe being connected to the upper surface of the inclined engine body.

20. An internal combustion engine as in claim 19, additionally comprising an exhaust system including an exhaust chamber, said exhaust chamber extending over at least a portion of said fuel injector.

21. An internal combustion engine as in claim 19, wherein said fuel injector is mounted so as to lie beneath a portion of the inclined cylinder.

22. An internal combustion engine for a small watercraft comprising a crankshaft journalled to rotate about a first axis within a crankcase, at least one inclined cylinder extending upwardly in an inclined manner from the crankcase, said at least one cylinder forming at least a portion of a combustion chamber of said engine, an intake system communicating with said at least one combustion chamber to provide air thereto, and a fuel system including at least one fuel injector that delivers fuel to said at least one combustion chamber, said fuel injector being connected to a lower surface of the inclined cylinder which extends over at least a portion of said fuel injector.

23. An internal combustion engine as in claim 22, wherein said intake system includes at least one intake pipe that is connected to an upper surface of said inclined cylinder.

24. An internal combustion engine as in claim 23 additionally comprising an exhaust system including at least one exhaust pipe, an inlet end of said exhaust pipe being connected to at least an upper surface of said inclined cylinder.

25. An internal combustion engine for a small watercraft comprising a crankshaft journalled to rotate about a longitudinal axis within a crankcase, at least a first cylinder extending upwardly from the crankcase, said first cylinder including at least one longitudinal side that lies along the longitudinal axis and a pair of lateral sides that lie on opposite sides of the longitudinal axis, an intake system communicating with said at least one cylinder to provide air thereto, a fuel system including at least a first fuel injector that delivers fuel to said at least one cylinder, and an exhaust system communicating with said at least one cylinder to expel exhaust gases therefrom, said fuel injector being connected to said longitudinal side, and said intake system and said exhaust system being connected to said lateral sides of said first cylinder on opposite sides of the longitudinal axis relative to each other.

26. An internal combustion engine as in claim 25 additionally comprising at least a second cylinder extending upward from said crankcase, and said fuel system including at least a second fuel injector connected to a longitudinal side of said second cylinder, said fuel injectors being arranged on opposite longitudinal ends of the engine.

27. An internal combustion engine for a small watercraft comprising a crankshaft journalled to rotate about a first axis within a crankcase of an engine housing assembly, said engine housing assembly including at least one cylinder extending upwardly from the crankcase, said at least one cylinder forming at least a portion of a combustion chamber of said engine, an intake system including at least one intake pipe connected to the engine housing assembly to provide air to said at least one cylinder through an effluent end of the intake pipe, and a fuel system including at least one fuel injector to provide fuel to said at least one combustion chamber, said fuel injector being skewed relative to a plane that lies generally normal to the first axis and includes an axis of said at least one cylinder, said intake pipe being arranged on said engine such that a flow axis through an effluent end of the intake is offset from said plane which contains the axis of said at least one cylinder.

28. A watercraft comprising a hull defining an engine compartment, an internal combustion engine positioned within the engine compartment, the engine including at least one combustion chamber, an induction system that provides air to said at least one combustion chamber, and a fuel system that provides fuel to said at least one combustion chamber, the fuel system including at least one fuel injector, said fuel injector being arranged on said engine such that at least part of said induction extends directly over at least a portion of said fuel injector so as to shield said fuel injector from water entering the hull through an access opening in the hull.

29. A watercraft as in claim 28, wherein said hull includes an access opening arranged above at least a portion of the engine, and at least a portion of said induction system lies between said access opening and at least said portion of said fuel injector.

30. A small watercraft as in claim 28, wherein said engine comprises at least one cylinder that forms at least a portion of said at least one combustion chamber, said cylinder having an inclined orientation relative to a vertical plane that extends along a longitudinal axis of the watercraft hull.

* * * * *

UNITED STATES PATENT AND TRADEMARK OFFICE
CERTIFICATE OF CORRECTION

PATENT NO. : 6,095,876

DATED : 8/1/00

INVENTOR(S): Ozawa et. al.

It is certified that error appears in the above-identified patent and that said Letters Patent is hereby corrected as shown below:

At column 15, line 23, please change "injection" to --injector--.
At column 18, line 30, after "induction", please insert --system--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*